US006914524B2

(12) United States Patent
Berndorfer et al.

(10) Patent No.: US 6,914,524 B2
(45) Date of Patent: Jul. 5, 2005

(54) APPARATUS AND METHOD FOR DETECTING IGNITION AND ENGINE CONDITIONS

(75) Inventors: Axel H Berndorfer, Nittel (DE); Fawaz N Budeiri, El Paso, TX (US)

(73) Assignee: Delphi Technologies, Inc., Troy, MI (US)

( * ) Notice: Subject to any disclaimer, the term of this patent is extended or adjusted under 35 U.S.C. 154(b) by 65 days.

(21) Appl. No.: 10/375,533

(22) Filed: Feb. 27, 2003

(65) Prior Publication Data

US 2004/0178900 A1 Sep. 16, 2004

(51) Int. Cl.[7] ..... Q60Q 1/00
(52) U.S. Cl. ..... 340/450.3; 340/439; 701/101
(58) Field of Search ..... 340/450.3, 825.06, 340/825.17, 439, 631, 648, 3.42, 450; 361/86, 92; 701/101, 111, 113

(56) References Cited

U.S. PATENT DOCUMENTS

| | | | | |
|---|---|---|---|---|
| 4,584,869 A | | 4/1986 | Frodsham | |
| 4,888,576 A | * | 12/1989 | Kubota et al. | 340/451 |
| 5,159,313 A | * | 10/1992 | Kawai et al. | 340/450.3 |
| 5,345,908 A | | 9/1994 | Nishimura et al. | |
| 5,382,942 A | * | 1/1995 | Raffa et al. | 340/457.4 |
| 5,535,722 A | | 7/1996 | Graessley et al. | |
| 5,699,250 A | * | 12/1997 | Kobayashi | 701/48 |
| 5,905,193 A | | 5/1999 | Hashizume et al. | |
| 6,082,322 A | * | 7/2000 | Graham et al. | 123/196 S |
| 6,239,709 B1 | | 5/2001 | Dykstra et al. | |
| 6,362,599 B1 | | 3/2002 | Turner et al. | 320/135 |
| 6,513,368 B2 | * | 2/2003 | Bondarowicz et al. | 73/53.05 |

* cited by examiner

*Primary Examiner*—Toan N. Pham
(74) *Attorney, Agent, or Firm*—Jimmy L. Funke

(57) ABSTRACT

A sensor system is provided configured to communicate data to a processing module of a vehicle, the processing module configured to perform computational analysis based on the data received from the sensor system, the sensor system including a means for determining a condition of an ignition switch for cranking an engine of the vehicle and a means for determining a running condition of the engine. Computational analysis of the received operational parameter data may be used to detect a catastrophic lubricant loss. Other computational analysis associated with the vehicle may be performed based on the operational parameter data. A method is provided for determining a condition of at least one operational parameter associated with an internal combustion engine of a vehicle and performing computational analysis associated with the vehicle based on the condition of the at least one operational parameter. The method may include determining whether a quantity of lubricant in a sump of the engine is below a threshold value, determining whether an ignition switch of the vehicle is in an on-position or an off-position, determining whether the engine of the vehicle is in a running condition or a not running condition, and flagging a catastrophic lubricant loss if the quantity of lubricant is below the threshold value and the ignition switch is in the on-position and the engine is in the running condition.

20 Claims, 3 Drawing Sheets

APPARATUS AND METHOD FOR DETECTING IGNITION AND ENGINE CONDITIONS

BACKGROUND OF THE INVENTION

The present invention relates in general to engine or vehicle sensors and in particular to engine or vehicle sensors or actuators having electronic and computational capabilities, which may allow them to measure, calculate, communicate or respond based on previously collected operational or functional data in combination with the ability to detect if an engine is running or not at a certain moment in time.

Today's automobiles and similar vehicles typically include highly sophisticated and complex systems and rely on control systems that receive input signals from a variety of sensing devices. Automobiles and similar vehicles powered by internal combustion engines depend on lubricating fluids such as oil or synthetic lubricants for lubricating moving components of the engine and to help maintain the engine at a proper operating temperature. Oil refining and formulation itself has become a complex process to ensure that internal combustion engines are properly lubricated and cooled during operation while taking into account environmental conditions such as temperature, humidity, etc. It is well known that oil quality varies and that over time the level of oil within an engine may be reduced due to leaks and/or oil combustion and that the performance characteristics or condition of the oil deteriorates or degrades. Consequently, numerous types of electronic sensors and sensor assemblies have been developed to monitor and/or detect oil level, oil temperature, and oil condition, for example.

The condition of lubricant such as oil in the sump of an internal combustion engine is an important factor in determining whether fresh oil needs to be added to a system or changed outright. Some algorithms or methods for making oil add/change decisions or notifying a driver of a catastrophic oil loss may depend on an ignition signal to determine whether the engine is running or shutdown. Ignition signals may not necessarily indicate whether the engine is actually running or shutdown. For instance, an ignition switch may be in the accessory position or in the on-position but not fully turned to crank the engine, which may falsely signal to an algorithm that the engine is running. A sensor system programmed to assume an engine running condition when the ignition is in the on-position may adversely affect oil condition algorithms, which may lead to a premature oil change. A false assumption of engine running may also lead to a false indication to a driver of catastrophic oil loss condition or may cause a faulty analysis of the operating characteristics of the oil, for example.

In view of the above, it would be advantageous to provide a sensor assembly and techniques for accurately detecting whether an automobile's engine is running or shutdown, notwithstanding the position of the automobile's ignition switch in order to more accurately determine oil quality, catastrophic oil loss, oil change and oil change reset conditions as well as other operational parameters associated with a vehicle.

BRIEF SUMMARY OF THE INVENTION

Extending the life cycle of a vehicle's lubricant, such as motor oil, is important to today's commercial and private motorists. Monitoring lubricant level in an oil pan or sump, for example, is an important indicator of whether new lubricant needs to be added, the existing lubricant needs to be changed and/or a catastrophic loss has occurred. Accurate level readings may be difficult if engine shutdown is determined by a microcontroller when the ignition signal feed to a level sensor switches between "1" and "0", for example, where "1" may indicate the switch is on and "0" may indicate it is off. A problem with this approach is that the ignition signal used to determine an engine running condition may remain in the "1" state even after the engine is shutdown. This allows for certain systems of an automobile to continue working after the ignition key is turned to the "off" position. Consequently, the microcontroller may falsely assume that the engine is on when receiving an ignition signal feed set to "1". This situation may make it difficult to discern between a catastrophic oil loss when the engine is actually running and a changing of the oil in the sump with the ignition switch on and the engine shutdown. Similarly, the ignition signal may be on or set to "1" when the key is in the accessory position and the engine is not running.

Using ignition signal feeds to the sensor assembly may also adversely impact oil condition trending or quality analysis algorithms, for example, in at least two ways. First, the number of real oil condition trend ("OCT") points may be reduced if the data for generating the OCT points is collected at predetermined intervals after engine shutdown. If the sensor assembly collecting the data for the OCT points determines engine shutdown by the ignition signal feed there may be an inherent delay in when the sensor will begin collecting data. The second adverse impact is that a fail-safe approach may assume that cumulative hours of ignition on are equivalent to the total hours of engine running. This would not be the case with the key in the accessory position or in the off position while other on-board systems are finalizing their processing. False engine running condition assumptions may cause a premature change of oil with unnecessary costs to the owner or operator.

One aspect allows for a sensor system configured to communicate data to a processing module of a vehicle where the processing module may be configured to process data received from the sensor system. The sensor system may include a first sensor module configured to determine a condition of an ignition switch for cranking an engine of the vehicle and a second sensor module configured to determine a running condition of the engine, wherein the respective determinations made by the first and second sensor modules influence the respective type of data processing performed by the processing module. For example, the processing module may perform computational analysis associated with the vehicle based on the respective determinations made by the first and second sensor modules.

One aspect allows for a method for determining a condition of at least one operational parameter associated with an internal combustion engine of a vehicle and performing computational analysis associated with the vehicle based on the condition of the at least one operational parameter. For example, the method may include determining the condition of operational parameters such as whether a quantity of lubricant in a sump of the engine is below a threshold value, whether an ignition switch of the vehicle is in an on-position or an off-position and whether the engine of the vehicle is in a running condition or a not running condition. The method allows for performing a computational analysis associated with the vehicle based on these determinations such flagging a catastrophic lubricant loss if the quantity of lubricant is below the threshold value and the ignition switch is in the on-position and the engine is in the running condition.

DETAILED DESCRIPTION OF THE INVENTION

Figure 1:
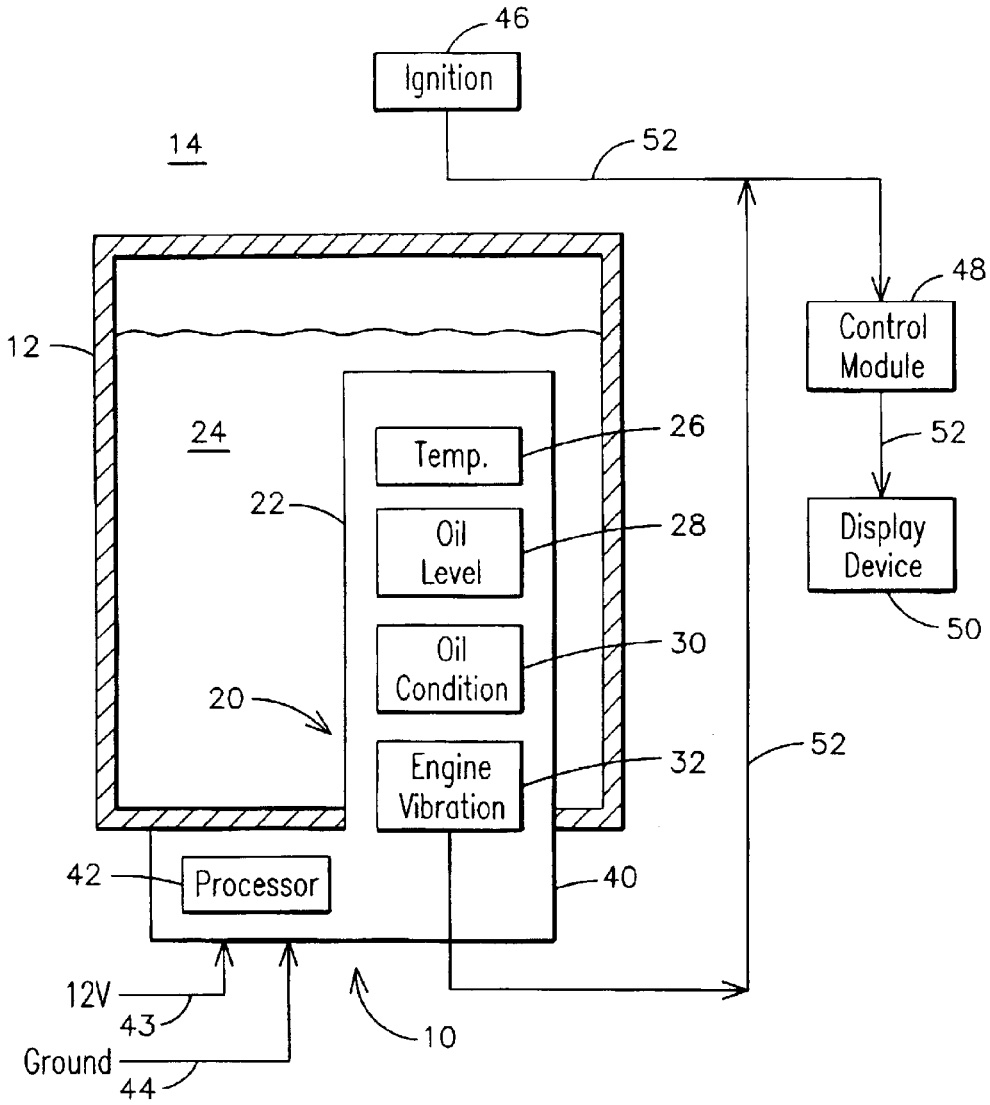
FIG. 1 is a schematic diagram of an exemplary embodiment of a sensor system of the present invention.

FIG. 1 illustrates an exemplary embodiment of a sensor system 10 that may be housed within the oil pan or sump 12 of an internal combustion engine 14 of a land based vehicle such as an automobile, for example. The sensor system 10 may include a housing 20 fabricated from suitable materials that may be inserted within an aperture at the bottom of sump 12 so that a tower portion 22 extends into a quantity of oil 24 within the sump 12. Suitable sealing, such as a radial O-ring seal, and attachment means may be used to prevent oil 24 from leaking out of sump 12 where the tower's interface with the sump 12 and for securing the sensor 10 to the sump 12. The tower 22 may be of a tubular construction having a hollow center so that a sufficient quantity of oil 24 is received within the tower 22. This is to ensure that oil 24 makes contact with or is otherwise placed in proper relation to one or more sensors that may be disposed within tower 22. Alternative embodiments allow for housing 20 to be other configurations provided it may be inserted into a standard sump 12 and is capable of maintaining one or more sensors in contact with oil 24. For example, the tower portion 22 may be a horizontal platform disposed across the bottom of and inside the sump 12 or the entire housing 20 could be mounted on the frame of an automobile or other secure location external to the sump with a fluid connection from the housing 20 to the sump 12. The fluid connection would allow for a sufficient quantity of oil 24 to be circulated through the housing 20 for one or more sensors to function according to aspects of the present invention. Other configurations will now be recognized by those skilled in the art.

In one exemplary embodiment of the present invention, means for measuring the temperature of oil 24, such as a electronic temperature sensor 26, may be disposed within the tower 22 for measuring the temperature of the oil 24 during operation of the engine 14 and/or after the engine 14 is shutdown. An oil level detection means, such as oil detection sensor 28, may be disposed in tower 22 for detecting the level of oil 24 in sump 12 before, during and/or after operation of engine 14. Means for measuring or determining the condition of oil 24, such as oil condition sensor 30, may be disposed within tower 22 for quantifying or qualifying the condition of oil 24 before, during and/or after operation of engine 14. The oil condition sensor 30 may include an oil condition trending and/or oil quality analysis algorithm, such as ones developed by the assignee of the present invention, for collecting and analyzing data indicative of variable properties of the oil 24 that affect its condition or suitability for continued use in engine 14. For example, the manufacturer specifications for engine 14 may suggest or require, for warranty purposes, that the operational characteristics and/or other variable properties of oil 24 be maintained above a minimum threshold or within a specified range. The oil condition trending algorithm may collect sets of data for analysis at various points in time, such as a predetermined time after the engine 14 is shutdown, to ensure the reliability of the results generated by the algorithm. Data may also be collected by sensor 30 based on other factors such as the temperature of the oil 24 during operation of the engine 14, for example.

Means for detecting vibration of engine 14 during an engine running condition, such as engine vibration sensor 32, may be provided in one exemplary embodiment. The vibration sensor 32 may be a conventional vibration sensor known in the art such as a piezoelectric sensor, for example. Vibration sensor 32 may be disposed within the tower 22 so that the sensor system 10 may be inserted within and removed from sump 12 as a unitary device. Alternate embodiments allow for the vibration sensor 32 to be mounted outside the housing 20 such as on a base portion 40 of housing 20, for example, so that sensor 32 is external to the oil 24 in sump 12. The vibration sensor 32 may be mounted at various other places, such as the frame of an automobile, provided a data signal detecting vibration is output from sensor 32 to the sensor system 10. Sensor 32 could also be an electronic component directly mounted, such as by surface mounting, on an electronic circuit board, which may be part of the processor 42, for example. The processor 42 may be provided on the sensor system 10. In one exemplary embodiment, the processor 42 may be mounted on or within the base portion 40 so that the sensor system 10 is a unitary device that may be easily removed from and inserted into the sump 12. Configuring the sensor system 10 as a unitary device is further advantageous in that it may be even more cost effectively manufactured, easily installed and subsequently accessed for use with an automobile, and easily maintained. A power supply, such as a 12-volt car battery, may supply power to the sensor system 10 through standard connections 43 and 44.

One exemplary embodiment of sensor system 10 may be interoperable with an ignition switch 46 for cranking engine 14, a control module 48 and a display device 50, all of which may be part of the operational system of automobile, for example. The control module 48 may be an electronic control module configured for overall data management and control of various systems of an automobile. It will be recognized by those skilled in the art that various aspects of the present invention may be executed by algorithms stored in databases associated with the control module 48 and/or the processor 42. Such algorithms may be stored in and executed from these databases and/or they may be executable as embedded code on processor 42 and/or the control module 48. A data link 52 may be provided to allow electronic data indicative of engine vibration and the operational characteristics or properties of the oil 24, such as temperature, level and condition, for example, to be transmitted from the processor 42 to the control module 48. The control module 48 may include a processing module configured for receiving the data indicative of temperature, level and condition and transmitting that data to the display device 50, which may be disposed in the dashboard of a vehicle for observation by a driver. The data indicative of oil 24 temperature, level and condition may be presented in the display device 50 as quantitative or qualitative information. For example, the oil 24 temperature may be presented as a whole number in any desired unit or the display device 50 may present to the driver that the oil 24 temperature is above normal or hot. Processor 42 may include a processing module for detecting a signal from the ignition switch 46 indicative of the position of the switch. A typical ignition switch of an automobile, for example, may be in one of at least an "on" position, an "off" position, an accessory position and a cranking position. One exemplary embodiment of the present invention allows for the processor 42 to receive data signals indicative of the switch being in the "on" and the "off" positions. A data signal of "1" may indicate "on" and a data signal of "0" may indicate "off". An alternate embodiment allows for these data signals to be transmitted to the control module 48.

Figure 2:
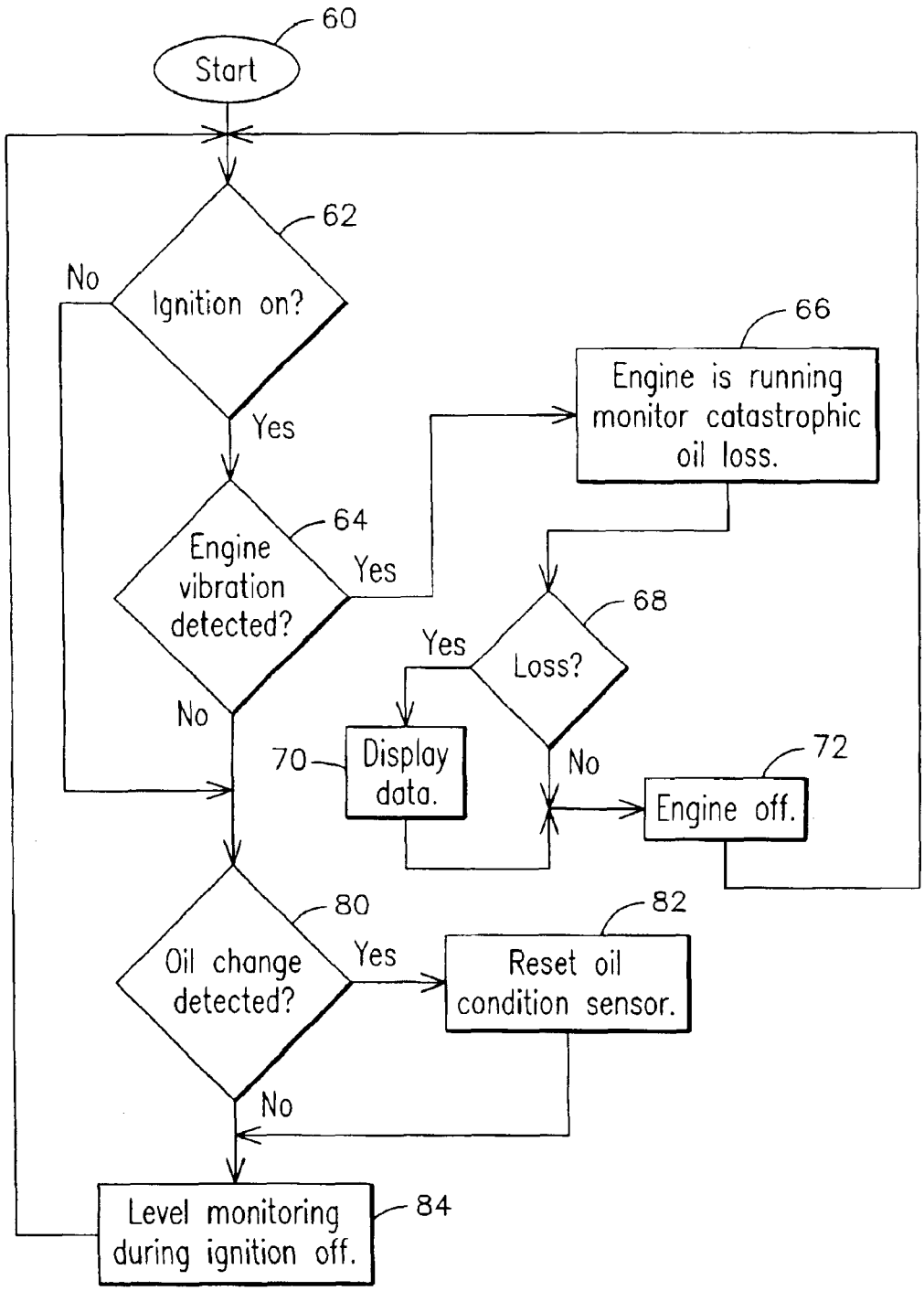
FIG. 2 is a flow chart of an exemplary method of the present invention.

FIG. 2 illustrates in one aspect an exemplary method of the present invention that may include after start step 60 a step 62 for determining whether the ignition switch 46 is in the "on" position. This determination may be made by a processing module of the processor 42 based on a data signal from the ignition switch 46. If the ignition switch 46 is in the "on" position then step 64 allows for determining whether an engine 14 vibration is detected. This determination may be made by a processing module of processor 42 based on a data signal output from engine vibration sensor 32. In one exemplary embodiment sensor 32 may be a piezoelectric sensor (e.g. accelerometer) packaged as a surface mount chip with an appropriate signal conditioning circuit for detecting the status of the engine. The engine status or condition may be running or not running and may be determined by the presence of vibration oscillations caused by the engine 14 being in a running condition. An alternate embodiment allows for the vibration sensor 32 to detect vibration oscillations generated by the turbulence of the oil 24 in sump 12 when the engine 14 is in a running condition. The sensor 32 may be calibrated to detect a minimum threshold of vibration oscillations that continue for a predetermined period of time to ensure that the engine 14 is started and in a continuous running condition or state. This allows for avoidance of a false engine running condition reading in the event the engine 14 stalls after being started or if the driver intentionally shuts down the engine, for example. If engine 14 vibration and/or oil 24 turbulence is detected in step 64 a conditioned signal may be output from engine vibration sensor 32 and inputted to the processor 42 and/or control module 48. The condition or status of this signal may be used for decision making by on-board algorithms. If the ignition switch 46 is in an on-condition and engine 14 vibration is detected then step 66 allows for processor 42 to be prompted for a catastrophic oil loss event to be monitored. Such an oil loss may be a sudden and appreciably large loss of oil 24 volume from sump 12 while the engine 14 is running, which may occur if the drain plug is missing or misaligned, for example. Detecting the loss may be accomplished by a data signal from oil level sensor 28 transmitted to processor 42 in the event sensor 28 detects that the level of oil 24 in sump 12 has dropped below a threshold. An alternate embodiment may use a separate sensor for detecting a catastrophic oil loss event and indicating that loss to processor 42. A catastrophic oil loss event may be monitored in step 66 the entire time that engine 14 is running. If a catastrophic oil loss event is detected in step 68 then step 70 allows for data indicative of such event to be transmitted to the display device 50. Sudden and/or catastrophic oil loss detection allows for a driver of an automobile to be warned of such an event, which may help prevent severe engine damage. If no event is detected and the engine 14 is shut off in step 72 then the exemplary method may return to step 62.

Returning to step 62, if the ignition switch 46 is not in the "on" position, or if it is in the "on" position but no engine 14 vibration is detected in step 64, then step 80 allows for determining whether an oil change is detected. An oil change may be detected by an oil change recognition algorithm module of processor 42 based on data signals from the oil condition sensor 30, for example, or by other methods known in the industry. If an oil change is detected then step 82 allows for the oil condition sensor 30 to be reset to a condition for monitoring changes in the condition of the oil added to the sump 12 during the oil change. Resetting the oil condition sensor 30 may be effected by a processing module of processor 42. A reset oil condition algorithm may be provided that allows for the oil condition sensor 30 to be reset whether the ignition switch 46 is in the "on" or "off" position. The algorithm may also allow for the detection of an oil change in step 80 when a vehicle, for example, is parked on an incline and/or whether the oil contains contamination. After resetting the oil condition or quality sensor in step 82, or determining that an oil change has not been detected in step 80, step 84 allows for the oil 24 level in sump 12 to be monitored while the ignition switch is in the "off" position. This oil level monitoring may be implemented by the oil level sensor 28 and an oil level recognition algorithm module of processor 42. The oil level may be continuously monitored in step 84 until an ignition switch 46 "on" condition is detected in step 62.

Figure 3:
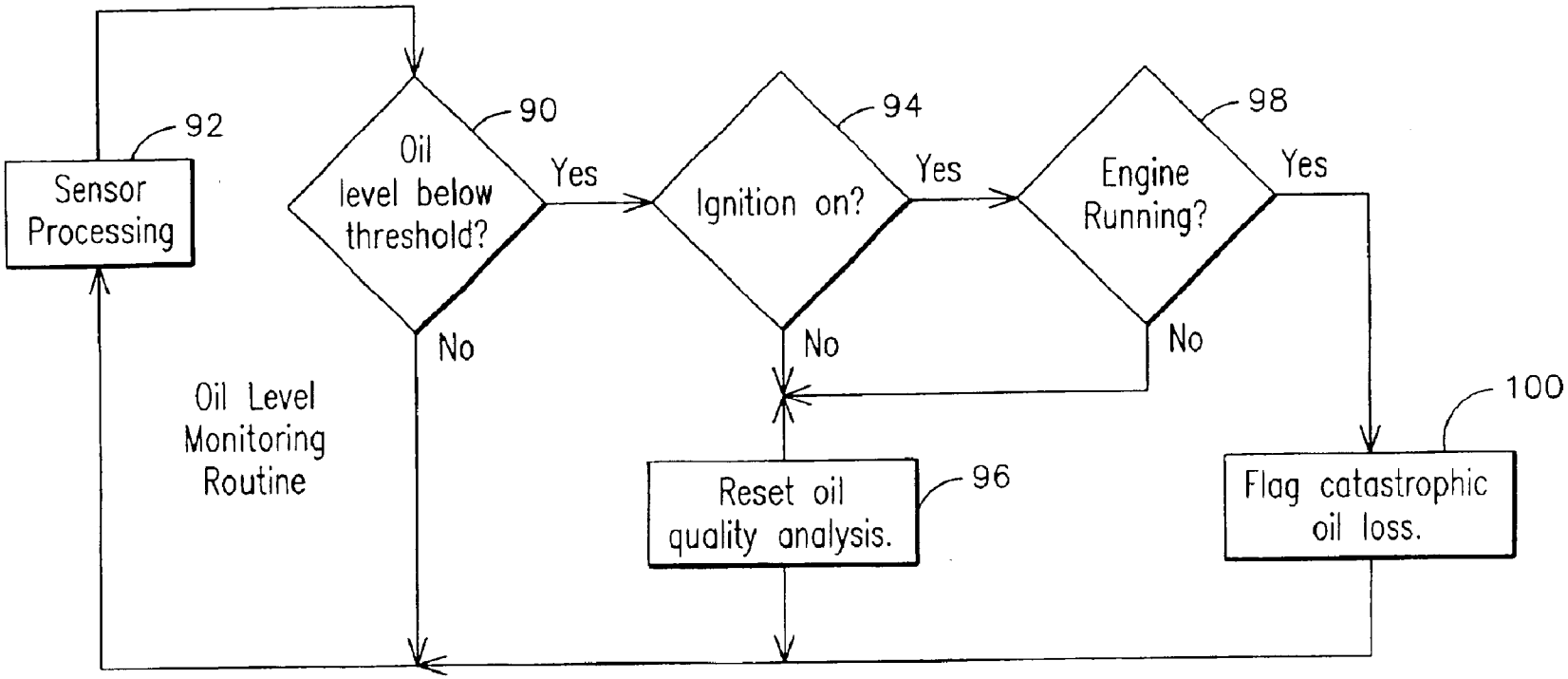
FIG. 3 is a flow chart of an exemplary method of the present invention.

One aspect allows for an exemplary method illustrated in FIG. 3 to continually execute an oil level monitoring routing whether an engine 14 is running or not. For example, step 90 allows for an oil level sensor 28 to continually monitor the oil level in an oil pan or sump 12 to determine whether the level falls below a threshold value. Such monitoring may be controlled in step 92 and executed at periodic or random intervals whether engine 14 is running or not by means of a controlling processor 42 that may be mounted on a circuit board, for example. If the oil level is below the threshold value then step 94 allows for determining whether an ignition switch is in the on-position. This may be determined by a data signal from the ignition switch or by a vibration sensor, for example. If no, step 96 allows for resetting an oil quality analysis algorithm that may be electronically stored in a database on a circuit board, for example, and associated with the processor 42. Step 96 allows for a set of oil quality parameters to be reset to their baseline conditions if the oil in the sump 12 has been changed or a sufficient volume has been added, for example. If the ignition is in the on-position in step 94 then step 98 allows for determining whether the engine 14 is actually running. If yes, then step 100 allows for a catastrophic oil loss event to be flagged, which may be accomplished by sending a data signal to the dashboard of an automobile, for example. If the engine 14 is not running in step 98 then the oil quality analysis algorithm may be reset in step 96.

While exemplary embodiments of the present invention have been shown and described by way of example only, numerous variations, changes and substitutions will occur to those of skill in the art without departing from the invention herein. Accordingly, it is intended that the invention be limited only by the spirit and scope of the appended claims.

What is claimed is:

1. A sensor system configured to communicate data to a control processing module of a vehicle comprising a multi-position ignition switch, an engine, an engine sump and a quantity of engine lubricant within the sump, the control processing module configured to process data received from the sensor system for analyzing properties of the engine lubricant, the sensor system comprising:

a vibration sensor for detecting vibration of the engine;

a processing module configured to receive a first data signal from the ignition switch indicative of a position of the ignition switch and a second data signal from the vibration sensor indicative of whether the engine is running or not running, wherein the data processing performed by the control processing module is based on the first and second data signals to avoid analyzing properties of the engine lubricant based on a false engine running condition.

2. The sensor system of claim 1 wherein the first data signal from the ignition switch is indicative of one of an on-position and an off-position.

3. The sensor system of claim 1 further comprising:

a housing comprising a hollow center in fluid communication with the quantity of engine lubricant within the engine sump.

4. The sensor system of claim 3, the housing further comprising a tower portion insertable within the sump of the engine.

5. The sensor system of claim 4 further comprising:

a temperature sensor within the tower portion configured to measure the temperature of the engine lubricant.

6. The sensor system of claim 4 further comprising:

a level sensor within the tower portion configured to measure a level of the quantity of engine lubricant within the sump of the engine and transmit a data signal of a catastrophic engine lubricant loss in the event the first data signal indicates the ignition switch is in an on-position and the second data signal indicates the engine is running and the level sensor detects a level of the engine lubricant in the engine sump is below a threshold value.

7. The sensor system of claim 4 further comprising:

an oil condition sensor within the tower portion configured to determine a quality condition of the quantity of engine lubricant.

8. A method for performing computational analysis of a lubricant's properties within an engine sump of a vehicle, the analysis based on an ignition switch position and a running condition of the vehicle's engine, the method comprising:

determining whether a level of lubricant in the sump of the engine is below a threshold value;

determining whether the ignition switch of the vehicle is in one of an on-position and an off-position;

determining whether the engine of the vehicle is in a running condition or a not running condition independent of the ignition switch position to avoid analysis of the lubricant's properties based on a false engine running condition; and flagging a catastrophic lubricant loss if the level of lubricant is below the threshold value and the ignition switch is in the on-position and the engine is in the running condition.

9. The method of claim 8 further comprising:

resetting a lubricant quality analysis algorithm to a set of baseline values if the level of lubricant is below the threshold value and the ignition switch is in the off-position.

10. The method of claim 8 further comprising:

resetting a lubricant quality analysis algorithm to a set of baseline values if the level of lubricant is below the threshold value and the ignition switch is in the on-position and the engine is in the not running condition.

11. The method of claim 8 further comprising:

detecting vehicle vibration to determine whether the engine of the vehicle is in the running condition or the not running condition.

12. The method of claim 8 further comprising:

monitoring the level of lubricant in the sump to determine whether the lubricant is below the threshold value when the engine is in the running condition and when the engine is in the not running condition.

13. The method of claim 8 further comprising:

providing a processing module configured to receive a first data signal from the ignition switch indicative of the ignition switch position and a second data signal from a vibration sensor indicative of the running condition of the engine.

14. The method of claim 8 further comprising:

mounting a housing comprising a hollow body to the vehicle, the hollow body in fluid communication with a portion of the lubricant; and connecting at least one sensor within the hollow body of the housing for determining a condition of the lubricant.

15. The method of claim 8 further comprising:

configuring a control processing module of the vehicle to receive data indicative of the ignition switch position and the running condition of the vehicle's engine;

programming the control processing module to execute a lubricant quality analysis algorithm that includes a set of baseline values; and resetting the lubricant quality analysis algorithm to the set of baseline values if the level of lubricant is below the threshold value and the ignition is in the off-position.

16. The method of claim 8 further comprising:

inserting a housing comprising a hollow portion into the sump to receive a portion of a quantity of the lubricant;

determining whether the level of lubricant in the sump is below the threshold value;

configuring a control processing module of the vehicle to receive data from the ignition switch indicative of the ignition switch position and the running condition of the vehicle's engine;

programming the control processing module to execute a lubricant quality analysis algorithm that includes a set of baseline values;

transmitting data indicative of whether the quantity of lubricant in the sump is below the threshold value from a lubricant level sensor to the control processing module; and resetting the lubricant quality analysis algorithm to the set of baseline values if the quantity of lubricant is below the threshold value and the ignition is in the off-position.

17. The method of claim 16 further comprising:

mounting a vibration sensor to the vehicle so that the vibration sensor is responsive to vibration of the engine;

configuring the vibration sensor to determine whether the engine is in the running condition or the not running condition based on engine vibration; and transmitting data from the vibration sensor indicative of whether the vehicle is in one of the running condition and the not running condition from the vibration sensor to the control processing module.

18. The method of claim 16 further comprising:

determining a temperature of the lubricant.

19. The method of claim 16 further comprising:

determining a condition of the lubricant.

20. The method of claim 8 further comprising:

transmitting data indicative of the catastrophic lubricant loss to a driver's compartment of the vehicle to indicate to a driver that a catastrophic lubricant loss has occurred.

* * * * *